US005311687A

United States Patent [19]

Reed

[11] Patent Number: 5,311,687

[45] Date of Patent: May 17, 1994

[54] DISPLAY SIGN

[75] Inventor: Harold Reed, Elk Grove Village, Ill.

[73] Assignee: Robert Nielsen & Associates, Ltd., Rolling Meadows, Ill.

[21] Appl. No.: 837,165

[22] Filed: Feb. 18, 1992

[51] Int. Cl.[5] ..... G09F 13/00

[52] U.S. Cl. ..... 40/502; 40/473; 362/324

[58] Field of Search ..... 40/564, 541, 545, 473, 40/431, 441, 502; 362/324, 370

[56] References Cited

U.S. PATENT DOCUMENTS 1,782,065 11/1930 Gwynn ..... 40/502
2,049,929 8/1936 Schlachman ..... 40/502
2,553,160 5/1951 Arps ..... 40/502
3,273,271 9/1966 Werner ..... 40/502
4,015,353 4/1977 Zarfati ..... 40/502

*Primary Examiner*—Brian K. Green
*Attorney, Agent, or Firm*—Lee, Mann, Smith, McWilliams, Sweeney, & Ohlson

[57] ABSTRACT

A display sign of considerable brightness for prominently displaying a name or message. In one form, the sign is formed in an elongate, rectangular fashion, while in another form, the sign is formed in an elongate, rotatable cylinder. In either form of the sign, the light source extends substantially the length of the sign, and a reflector is poised behind the light source for enhancing illumination.

7 Claims, 3 Drawing Sheets

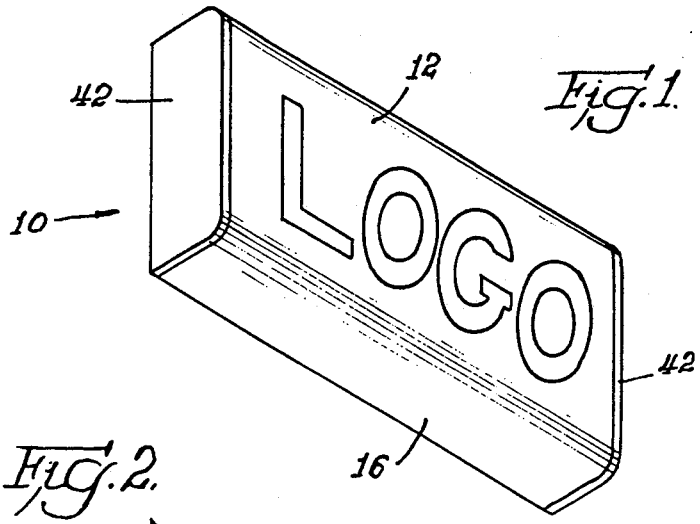
Fig. 1.
Fig. 2.
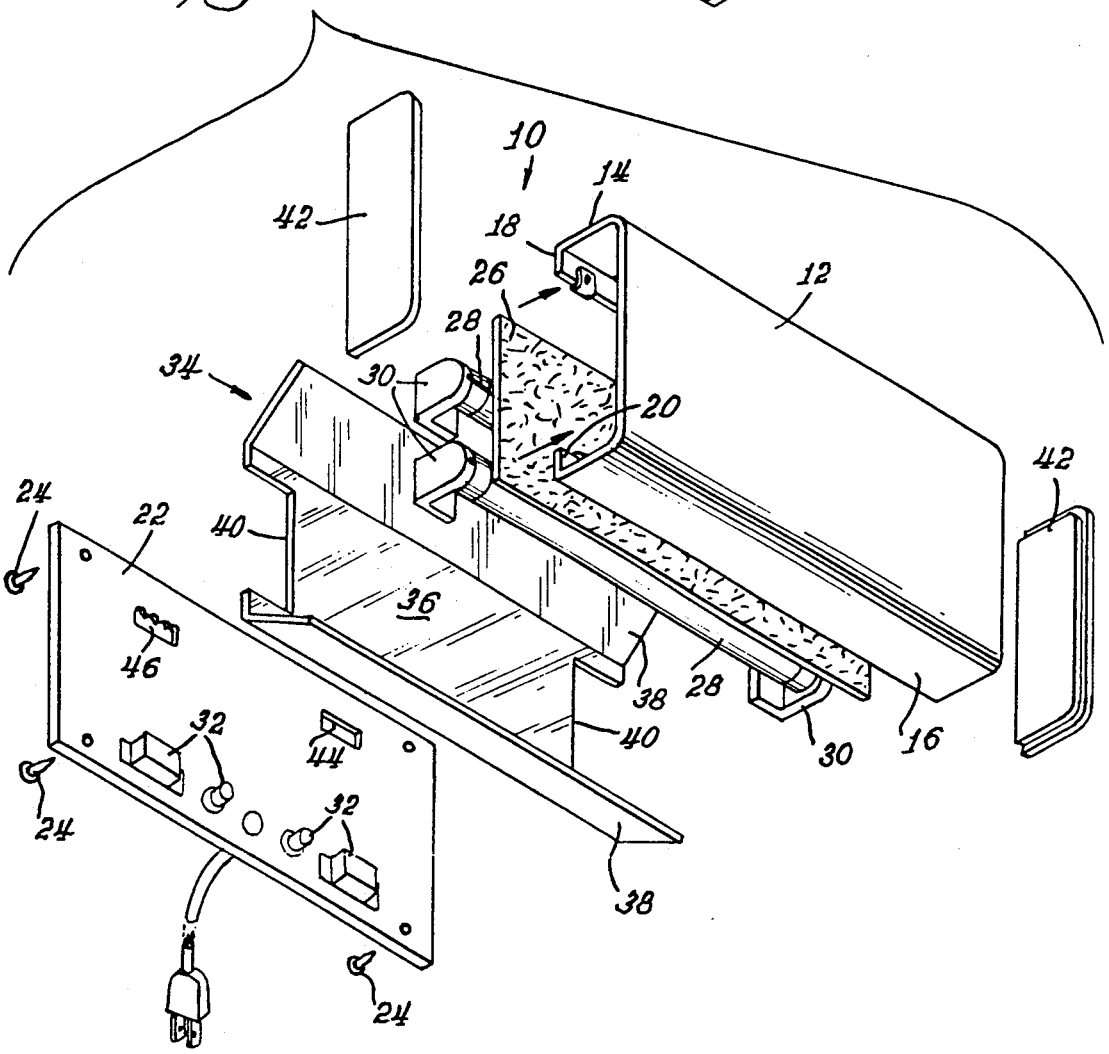

50
52
54
56
58
60
62
64
66
68
70
72
74
76
78
80
82
86
88
90
92
94

DISPLAY SIGN

BACKGROUND OF THE INVENTION

This invention relates to display signs, and in particular to a display sign that is exceptionally bright and clear.

Back lit display signs are common, and are used for endless advertising and informational purposes. In a typical sign, a logo or message is printed on a glass or plastic plate, and the remainder of the plate is darkened or coated to be opaque to the passage of light. When the plate is back lit, only the logo or message imprinted thereon is visible.

It is important that the display of the sign be as clear and visible as possible. Therefore, in the past, diffusers or reflectors have been employed for focusing and directing the light which is back lighting the logo or message.

SUMMARY OF THE INVENTION

The invention pertains to a display sign which, in a first form, comprises an elongate body having an illumination means within the body for illuminating the body substantially from end to end. A display portion extends along a front side of the body, with the display portion comprising a display plate forming an exterior side of the body and carrying the message to be displayed, and a light diffuser means extending beneath the display plate between the display plate and the illumination means. The body is provided with a backside, and a reflector extends substantially the length of the body along the backside beneath the illumination means. The reflector has a flat reflective portion extending the length of the body and at least one angled reflective portion also extending the length of the body but at an angle to the flat reflective portion. End caps are provided at opposite ends of the body to close the body.

In accordance with a first form of this embodiment of the invention, the display plate includes integral side portions extending substantially perpendicular to the display plate and forming side borders of the body. The end caps are secured to the display plate in an appropriate fashion, such as by gluing. Preferably, a pair of the angled reflective portions are employed, each being located at an edge of the flat reflective portion for properly reflecting light from the illumination means. It is preferred that the angled reflective portions extend at about a 45° angle to the flat reflective portion.

In another form of the first embodiment of the invention, the body includes opposite mounting channels for the display plate, with the channels extending between the end caps. At least one of the end caps is removable to permit the display plate to be removed endwise from the channels.

In either form of the invention, it is preferred that the illumination means comprise at least one elongated tube, such as a fluorescent tube, which extends the length of the elongate body. The reflector includes a flat reflective portion extending beneath each tube and a pair of the angled reflective portions on opposite sides of the tube and the flat reflective portion for properly directing light from the tube.

In a second embodiment of the invention, the display sign comprises an elongate body, with illumination means extending within the body for illuminating the body substantially from end to end. A display portion is provided comprising at least a part of the elongate body, with the display portion including a hollow, elongate rotatable display cylinder forming an exterior for the display portion. Means is provided for mounting the display cylinder for rotation, and a back support is provided for mounting of the body. A stationary reflector extends within the cylinder substantially the length of the cylinder, the reflector being curved and including at least one end projection extending from the cylinder. A mounting bracket extends from the back support and engages the end projection to hold the stationary reflector in place while the cylinder rotates.

In this embodiment of the invention, the illumination means also comprises an elongated tube which has opposite ends extending beyond the cylinder. Means is provided for mounting the tube at its ends to hold the tube in place while the cylinder rotates.

For mounting of the cylinder, a bearing is provided at each end with a bearing bracket being secured to the back support. For rotating the cylinder, a motor is provided secured to the back support and a ring gear is mounted on one end of the cylinder, with the motor including a drive pinion engaging the ring gear.

The reflector is cylindrical, and includes a light emitting opening extending the length of the reflector. Preferably, the reflector includes an end projection at each end of the reflector extending from the ends of the cylinder. Each end projection has a first clip element formed therein which engages one of the mounting brackets secured to the back plate. Each mounting bracket has a second clip element complementary to the first clip element. One of the clip elements comprises a pair of opposite ears, and the other of the clip elements comprises a pair of complementary latches each shaped to engage one of the ears.

BRIEF DESCRIPTION OF THE DRAWINGS

The invention is described in greater detail in the following description of examples embodying the best mode of the invention, taken in conjunction with the drawing figures, in which:

FIG. 1 is a perspective view of a first form of a first embodiment of the invention, FIG. 2 is an exploded view of the sign shown in FIG. 1, illustrating detail.

DESCRIPTION OF EXAMPLES EMBODYING THE BEST MODE OF THE INVENTION

Figures 3, 4, 5, 6:
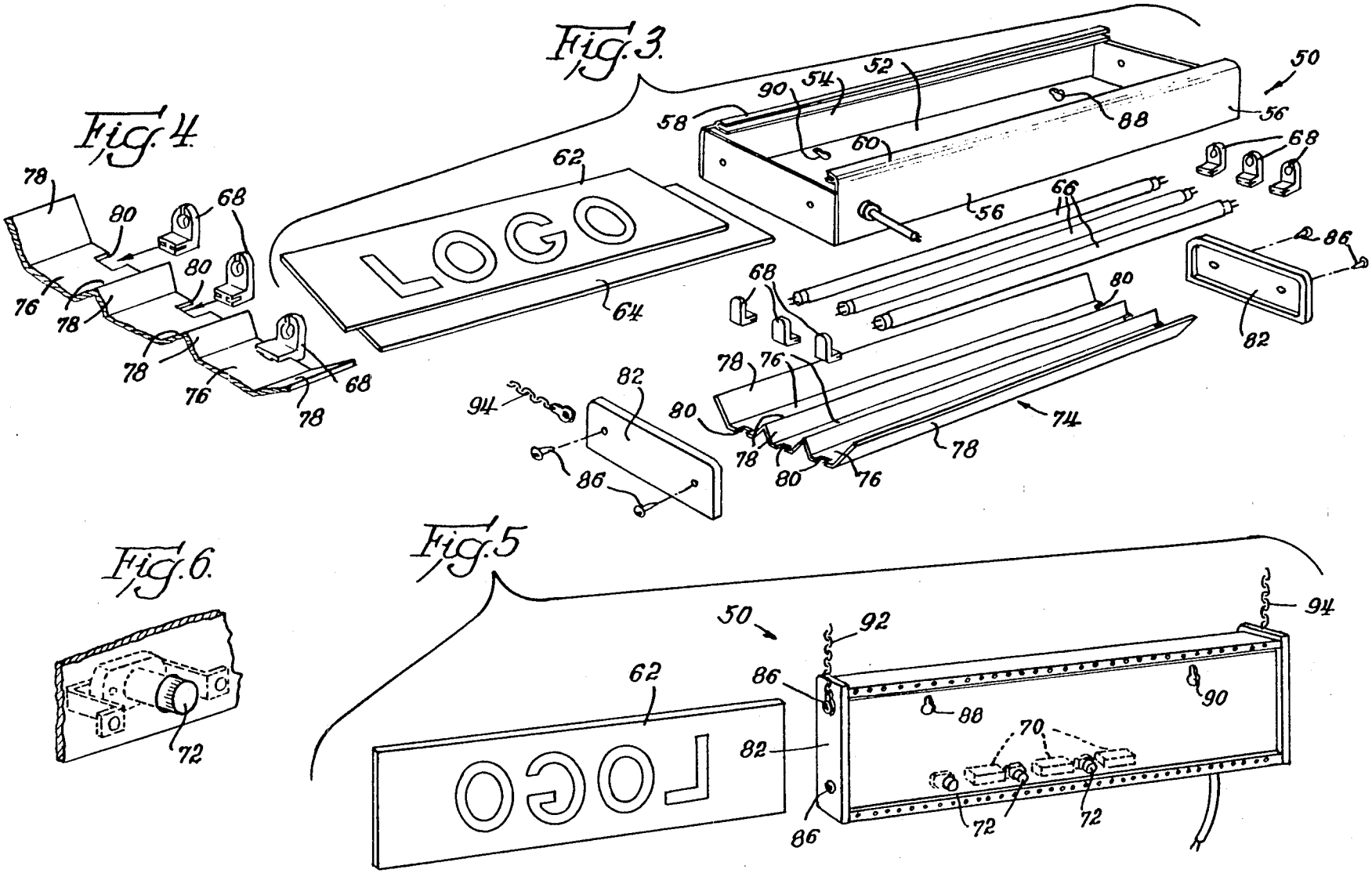
FIG. 3 is an exploded assembly view of a second form of the first embodiment of the invention.
FIG. 4 is an enlarged perspective end view of a portion of the reflector of the invention showing how the fluorescent tube contacts are mounted in place.
FIG. 5 is a back view of the sign shown in FIG. 3.
FIG. 6 is an enlarged view of a mount for a fluorescent starter.
Figure 7:
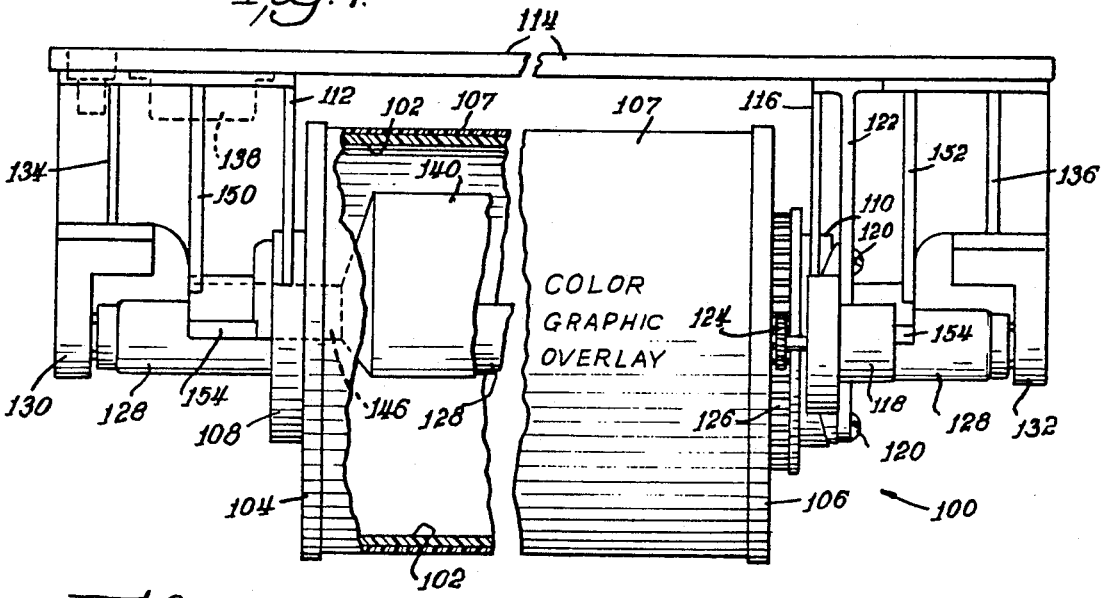
FIG. 7 is an elevational view of a second embodiment of the invention, with portions broken away to show detail and being truncated to shorten elongated portions.

One form of a first embodiment of the display sign of the invention is shown generally at 10 in FIGS. 1 and 2.

The display sign 10 is in the form of an elongate body, having a display portion comprising a display plate 12 with integral side portions 14 and 16 extending substantially perpendicular to the display plate 12 and forming side borders of the elongate body of the display sign 10. The side portions 14 and 16 each have respective inwardly turned flanges 18 and 20 which may be appropriately affixed to a back plate 22 by fasteners 24 or the like.

In a conventional fashion, the display plate 12, which can be glass, plexiglass or any other suitable material, includes a logo or message printed thereon, with the remainder of the plate 12 being light opaque so that only the logo or message will appear when back lit. For properly diffusing light, a diffuser 26 is located directly beneath the display plate 12, extending for the length and width of the display plate 12.

Light is provided by a pair of fluorescent tubes 28. Each of the tubes 28 is mounted in an end contact 30 which is appropriately affixed to the back plate 22, and which is connected to excitation circuitry 32 in a conventional fashion, the circuitry 32 being mounted on the back plate 22 as shown.

A reflector 34 is provided for enhancing the light output of the fluorescent tubes 28. The reflector extends substantially the length of the display sign 10 beneath the fluorescent tubes 28, and includes a flat reflective portion 36 and a pair of angled reflective portions 38. The reflective portion 36 is cut out at 40 at its opposite ends in order to accommodate the end contacts 30 where they are affixed to the back plate 22. The angled reflective portions 38 extend from the side edges of the flat reflective portion 36, and are preferably angled at an angle of about 45° with respect to the flat reflective portion in order to properly direct light from the fluorescent tubes 28 through the diffuser 26 to the back of the display plate 12. Alternatively, the angled reflective portions 38 can be curved, such as in a parabolic curve, in order to direct light to the back of the display plate 12. It is important that the angled reflective portions 38 be provided to enhance the light output from the fluorescent tubes 28, making the brightness of the display sign 10 as great as possible.

The diffuser 26 may be formed from a textured plastic, such as polystyrene, while the reflector 34 is preferably formed with a mirrored surface. It may be made of styrene or any other material which is capable of carrying a mirrored surface for reflecting of as much light from the fluorescent tubes 28 as possible.

The display sign 10 is provided with a pair of end caps 42 which preferably are glued to the display plate 12. Thus, access to the interior of the display sign 10, for changing of the fluorescent tubes 28 or accessing the circuitry 32, is by removal of the back plate 22.

The display sign 10 can be wall mounted, and is provided with a pair of apertures 44 and 46 for such mounting. One of the apertures can be provided with a scalloped top, such as shown in the aperture 46, for proper alignment of the sign 10 when wall mounted.

A second form 50 of the first embodiment of the display sign of the invention is shown in FIGS. 3–6. This form of the invention is also comprised of an elongate body having a back plate 52 with upstanding sides 54 and 56, each of which has a respective mounting channel 58 and 60 formed therein. The channels 58 and 60 are formed to accommodate a display plate 62 which is underlain by a diffuser 64. When the display sign 50 is assembled, access to the interior of the display sign 50 is by means of endwise sliding of the display plate 62 and diffuser 64 from the mounting channels 58 and 60.

The display sign 50 is illuminated by a series of fluorescent tubes 66. The tubes 66 are mounted in respective contacts 68 which are connected to appropriate excitation circuitry 70 mounted on the back plate 52. As best shown in FIG. 6, and as is conventional, the excitation circuitry 70 includes a starter ballast 72 for each of the fluorescent tubes 66, the ballasts being accessible from the rear of the display sign 50 through appropriate apertures therein. All circuitry for excitation of the fluorescent tubes 66 is conventional, and therefore is not described in further detail.

For enhancement of the light output of the fluorescent tubes 66, the tubes 66 are underlain by a reflector 74 which is appropriately affixed to the back plate 52. The reflector 74 is composed of a series of flat reflective portions 76, each being sandwiched between a pair of angled reflective portions 78. The flat reflective portions and respective angled reflective portions are situated beneath each of the fluorescent tubes 66 for aiming of light from the tubes 66 to the back side of the display plate 62 for back lighting of the plate. In the same manner as the angled reflective portions 38 of the first form of the display sign 10, the angled reflective portions 78 can be parabolic or otherwise curved for light reflection. In the form illustrated, it is preferred that the angled portions extend at about a 45° angle to their reflective flat reflective portions 76.

The contacts 68 for the fluorescent tubes 66 are installed in notches 80 formed in the ends of the reflector 74. Each of the contacts 68 may be formed with slots which engage the notches 80 in a conventional fashion.

Similar to the first form of the invention, the reflector 74 is silvered or otherwise provided with a reflective surface for maximum reflection of light from the fluorescent tubes 66. The reflector 74 may be formed of plastic, metal or any other material to which a reflective surface can be applied. The display plate 62 and diffuser 64 are formed in the same manner as the corresponding elements of the first form of the invention shown in FIGS. 1 and 2.

End caps 82 are provided to close the ends of the display sign 10 and prevent the display plate 62 from inadvertently sliding out of the display sign 50 or from being removed without physical removal of the end caps 82. The end caps 82 are affixed in place to upturned flanges 84 by means of fasteners 86.

The display sign 50 can be wall mounted, and is provided with a pair of apertures 88 and 90 in the back plate 52 for such mounting. Alternatively, the display sign 50 can be hung from chains 92 and 94 which are affixed to the end caps 82 by the fasteners 86.

A second embodiment of display sign 100 is shown generally in FIGS. 7–10. In this form of the invention, the display sign 100 is composed of an elongate body having a display portion comprising at least a part of the elongate body and including a hollow, elongate and rotatable display cylinder 102 closed at opposite ends by respective end caps 104 and 106. The display cylinder 102 may be underlain by a cylindrical diffuser (not illustrated), and is preferably overlain by a graphic overlay 107 carrying the logo, message or other information displayed by the display sign 100. The display cylinder 102 constitutes the exterior of the display portion.

Respective bearings 108 and 110 are secured to the end caps 104 and 106. The bearing 108 is mounted in a bearing bracket 112 secured to a back support 114.

Similarly, the bearing 110 is mounted in a bearing bracket 116 secured to the back support 114.

A motor 118 is provided for rotation of the cylinder 102. The motor 118 is attached by a pair of fasteners 120 to an arm 122 extending from and attached to the back support 114. The motor 118 includes a drive pinion 124 which engages a ring gear 126 mounted about the bearing 110 and affixed to the end cap 106.

For illumination of the graphic overlay 107, the display sign 100 includes an internal fluorescent tube 128 extending through open ends of the end caps 104 and 106. Opposite ends of the fluorescent tube 128 are mounted in respective end contacts 130 and 132 which are mounted on brackets 134 and 136 extending from the back support 114. Excitation circuitry 138 is provided to excite the fluorescent tube 128 in a conventional fashion.

Figure 8:
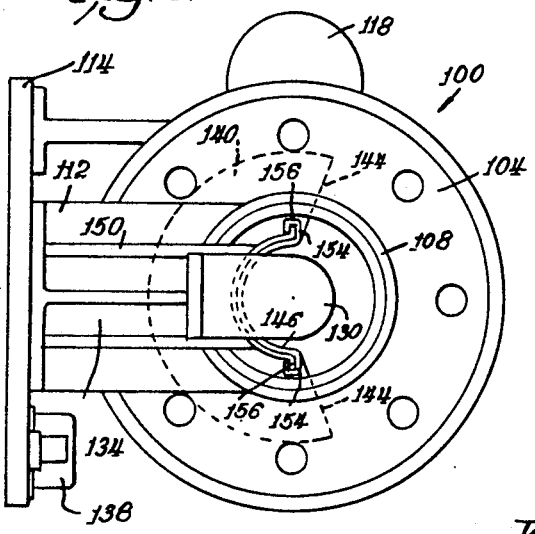
FIG. 8 is a left end view of the embodiment of the invention shown in FIG. 7.
Figure 9:
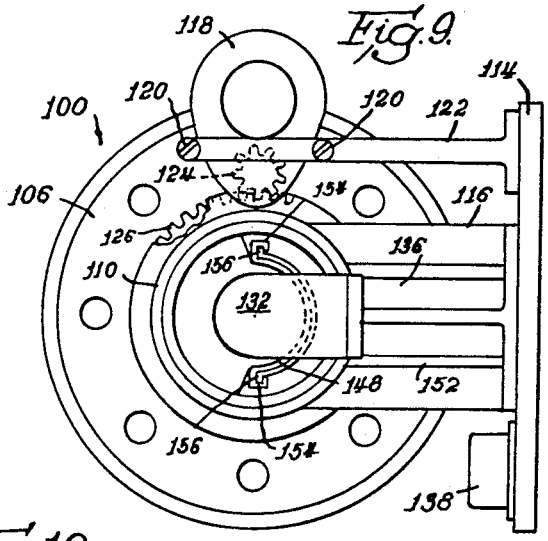
FIG. 9 is a right end view of the embodiment of the invention shown in FIG. 7.
Figure 10:
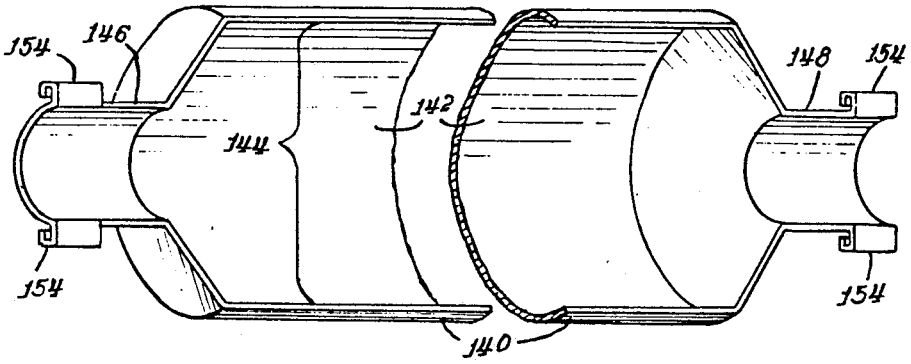
FIG. 10 is a truncated perspective view of the reflector employed in the embodiment of FIG. 7.

The fluorescent tube 128 is underlain by a stationary reflector 140. The reflector 140 is preferably curved to conform to the cylindrical configuration of the display cylinder 102, and has a silvered, reflective interior 142 for reflecting light from the fluorescent tube 128. The reflector 140 has a light emitting opening 144 extending along the length of the reflector 140 to properly direct and reflect light from the fluorescent tube 128 to the underside of the graphic overlay 107. As shown in FIG. 8, the opening 144 can be limited as desired in order to direct light from the fluorescent tube 128 to only a sector of the display cylinder 102. The relative size of the opening 144 will depend on the amount of illumination of the display cylinder desired.

The reflector 140 includes end projections 146 and 148 extending from the opposite ends thereof, and engaging respective mounting brackets 150 and 15 extending from the back support 114. Each of the ends projections 146 and 148 includes a clip element which engages a respective clip element formed in its mounting bracket. The clip elements of the end projections 146 and 148 each comprise a pair of complementary latches 154 which are shaped to engage ears 156 formed in the mounting brackets 150 and 152.

In operation, only the cylinder 102, its graphic overlay 107, the associated end caps 104 and 106 and the ring gear 126 are rotated when the motor 118 is activated. The pinion 124 drives the ring gear 126 to rotate the cylinder 102, while the reflector 140 is held firmly in place in the respective mounting brackets 150 and 152, and the fluorescent tube 128 is held firmly in place in the end contacts 130 and 132 seated on the brackets 134 and 136. The ends of the fluorescent tube 128 extending from the cylinder 102 are preferably covered by a cowl (not illustrated) or otherwise shrouded so that only the back lit display cylinder 102 is visibly lit to persons in proximity to the display sign 100.

Various changes can be made to the invention without departing from the spirit thereof or scope of the following claims.

What is claimed is:

1. A display sign comprising a. an elongate sign body, b. illumination means within said body for illuminating said body substantially from end to end, c. a display portion comprising at least a part of said elongate body, said display portion including i. a hollow, elongate rotatable display cylinder forming an exterior for said display portion, and ii. means mounting said display cylinder for rotation, d. a back support for said body, e. a stationary reflector extending within said cylinder and having a length substantially the same as a length of said cylinder, said reflector being curved and including an end projection extending from each end of said cylinder, each end projection having a first clip element, and f. a mounting bracket extending from said back support and engaging each said end projection, said mounting bracket having a second clip element complementary to each said first clip element.

2. A display sign according to claim 1 in which said illumination means comprises an elongated tube having opposite ends extending beyond said cylinder, and including means mounting said tube at said ends.

3. A display sign according to claim 1 in which said mounting means comprises a bearing at each end of said cylinder and a bearing bracket secured to said back support.

4. A display sign according to claim 1 including means for rotating said cylinder.

5. A display sign according to claim 4 in which said means for rotating comprises a motor secured to said back support and a ring gear mounted on one end of said cylinder, said motor including a drive pinion engaging said ring gear.

6. A display sign according to claim 1 in which said reflector is cylindrical, and includes a light emitting opening extending the length of said reflector.

7. A display sign according to claim 1 in which one of said clip elements comprises a pair of opposite ears, and the other of said clip elements comprises a pair of complementary latches each shaped to engage an ear.

* * * * *